United States Patent [19]

Hayashi

[11] Patent Number: 4,788,943

[45] **Date of Patent: * Dec. 6, 1988**

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[ * ] Notice: The portion of the term of this patent subsequent to May 5, 2004 has been disclaimed.

[21] Appl. No.: 852,239

[22] Filed: Apr. 15, 1986

[30] Foreign Application Priority Data

May 30, 1985 [JP] Japan ..... 60-117386

[51] Int. Cl.[4] ..... F01P 3/22

[52] U.S. Cl. ..... 123/41.27; 123/41.21

[58] Field of Search ..... 123/41.2–41.27; 165/104.27, 104.32

[56] References Cited

U.S. PATENT DOCUMENTS 4,330,033 5/1982 Okada et al. ..... 165/104.27
4,352,342 10/1982 Cser et al. ..... 165/104.32
4,458,747 7/1984 Berry et al. ..... 165/104.32
4,563,983 1/1986 Hayashi et al. ..... 123/41.21
4,662,317 5/1987 Ogawa ..... 123/41.27
4,677,942 7/1987 Hayashi ..... 123/41.27

FOREIGN PATENT DOCUMENTS 201918 11/1984 Japan ..... 123/41.27

OTHER PUBLICATIONS

Patent Abstracts of Japan, M-394, Jul. 6, 1985, vol. 9, No. 162, (Abstract of JP-A 60-36714 of Feb. 25, 1985).

*Primary Examiner*—Tony M. Argenbright
*Assistant Examiner*—Eric R. Carlberg
*Attorney, Agent, or Firm*—Foley & Lardner, Schwartz, Jeffery, Schwaab, Mack, Blumenthal & Evans

[57] ABSTRACT

The present invention provides an evaporative cooling system for an automotive engine or the like which system does not require a plurality of electromagnetic valves and conduits and which can control the boiling point to a level appropriate for the instant mode of engine operation.

13 Claims, 6 Drawing Sheets

COOLING SYSTEM FOR AUTOMOTIVE ENGINE OR THE LIKE

BACKGROUND OF THE INVENTION

Field of the Invention

The present invention relates generally to an evaporative type cooling system for an internal combustion engine wherein liquid cooling is permitted to boil and the vapor used as a vehicle for removing heat therefrom, and more specifically to such a system which does not require a plurality of electromagnetic valves and a complex control circuit to ensure that the system remains free of contaminating non-condensible matter and which can control the boiling point of the coolant in accordance with the instant mode of engine operation.

Description of the Prior Art

In currently used "water cooled" internal combustion engines (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat.

Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times 14$) must be produced by the water pump. This of course undesirably consumes several horsepower. Further, the large amount of coolant utilized in this type of system renders the possibility of quickly changing the temperature of the coolant in a manner that instant coolant temperature can be matched with the instant set of engine operational conditions such as load and engine speed, completely out of the question.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity. This arrangement while eliminating the power consuming coolant circulation pump which plagues the above mentioned arrangement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency. Further, with this system in order to maintain the pressure within the coolant jacket and radiator at atmospheric level, a gas permeable water shedding filter 5 is arranged as shown, to permit the entry of air into and out of the system.

However, this filter permits gaseous coolant to readily escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve. This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator.

Due to the difference in specific gravity, the above mentioned air tends to rise in the hot environment while the coolant which has condensed moves downwardly. The air, due to this inherent tendency to rise, tends to form pockets of air which cause a kind of "embolism" in the radiator and which badly impair the heat exchange ability thereof. With this arrangement the provision of the compressor renders the control of the pressure prevailing in the cooling circuit for the purpose of varying the coolant boiling point with load and/or engine speed difficult.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device.

Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Further, the rate of condensation in the condensor is controlled by a temperature sensor disposed on or in the condensor per se in a manner which holds the pressure and temperature within the system essentially constant. Accordingly, temperature variation with load is rendered impossible.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation.

However, this arrangement has proved totally unsatisfactory in that upon boiling of the liquid coolant absorbed into the ceramic layers, the vapor thus produced and which escapes toward and into the coolant jacket, inhibits the penetration of fresh liquid coolant into the layers and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 5 shows an evaporation type cooling system disclosed in Japense Patent Application Second Provisional Publication No. 47-5019. This arrangement is such that when the coolant in the coolant jacket 15 heats and expands the excess coolant is displaced from the top of the radiator 16 to a reservoir 17 via a discharge conduit 18. This conduit, as shown, extends into the reservoir 17 and terminates close to the bottom thereof. With this arrangement when coolant vapor is discharged from the radiator 16 it bubbles through the liquid coolant in the reservoir 17 and condenses. A cooling fan 19 is arranged to induce a cooling draft of air to pass over the finned tubing of the radiator and induce coolant vapor to condense. Depending on the ambient temperature and the amount of heat being produced by the engine the level of liquid coolant reduces under the boiling action until an equilibrium level is established.

When the engine stops and cools, coolant from the reservoir 18 is re-inducted to fill the radiator 16 and coolant jacket 18. The chamber 20 which is fluidly communicated with the bottom of the reservoir acts as a gas spring.

However, with this arrangement as the system is hermetically sealed control of the boiling point of the coolant using only the fan is extremely difficult.

FIG. 8 shows an arrangement which is disclosed in U.S. Pat. No. 4,549,505 issued on Oct. 29, 1985 in the name of Hirano. The disclosure of this application is hereby incorporated by reference thereto. For convenience the same numerals as used in the above mentioned Patent are also used in FIG. 8.

However, this arrangement while solving the drawbacks encountered with the previously disclosed prior art has itself suffered from the drawbacks that a plurality of electromagnetic valves and conduits are required to enable the desired temperature and coolant control. This adds to the cost and complexity of the system as well as increasing the crowding of the engine compartment when used in conjunction with an automotive engine.

SUMMARY OF THE INVENTION

It is an object of the present invention to provide an evaporative cooling system for an automotive engine of the like which system does not require a plurality of electromagnetic valves and conduits and which can control the boiling point to a level appropriate for the instant mode of engine operation without the provision thereof.

A first aspect of the present invention comes in the form of a cooling system for an internal combustion engine having a structure subject to high heat flux, the cooling system being characterized by: a coolant jacket disposed about the structure and into which coolant is introduced in liquid form and discharged in gaseous form; a radiator in fluid communication with the coolant jacket and in which coolant vapor is condensed to its liquid state; means for returning the liquid coolant formed in the radiator to the coolant jacket in a manner which maintains the level of liquid coolant in the coolant jacket at a first predetermined level, the first predetermined level being selected to maintain the structure immersed in a predetermined depth of liquid coolant, the coolant jacket, radiator and the liquid coolant returning means defining a cooling circuit; a reservoir in constant fluid communication with the cooling circuit; and a valve which controls the communication between the interior of the reservoir and the ambient atmosphere, the valve being operable to selectively control the pressure in the reservoir and the cooling circuit.

A second aspect of the invention comes in the form of an internal combustion engine having a structure subject to high heat flux the engine having a cooling system which comprises: a coolant jacket disposed about the structure and into which coolant is introduced in liquid form and discharged in gaseous form; a radiator in fluid communication with the coolant jacket and in which coolant vapor is condensed to its liquid state; means for returning the liquid coolant formed in the radiator the coolant jacket in a manner which maintains the level of liquid coolant in the coolant jacket at a first predetermined level, the first predetermined level being selected to maintain the structure immersed in a predetermined depth of liquid coolant; the coolant jacket, radiator and liquid coolant return means defining a cooling circuit; a temperature sensor disposed in the coolant jacket; means for determining the instant mode of engine operation and for determining a target temperature at which the coolant should be maintained; a device associated with the radiator for varying the rate of heat exchange between the radiator and a cooling medium surrounding the radiator; a reservoir in constant fluid communication with the cooling circuit; a valve which controls the fluid communication between the interior of the reservoir and the ambient atmosphere; control means for operating the valve in a manner which controls the pressure in the reservoir and cooling circuit and for operating the device to vary the rate of heat exchange between the radiator and the cooling medium in a manner which brings the temperature of the coolant in the coolant jacket to the target temperature.

A third aspect of the present invention comes in the form of a method of cooling an internal combustion engine which has a structure subject to a high heat flux, the method comprising: introducing liquid coolant into a coolant jacket disposed about the structure; permitting the liquid coolant to absorb heat and boil; condensing the coolant vapor produced in the coolant jacket to its liquid form in a radiator; returning liquid coolant from the radiator to the coolant jacket in a manner which maintains the structure immersed in a predetermined depth of liquid coolant; storing coolant in a reservoir which constantly communiates with the radiator; and controlling fluid communication between the interior of the reservoir and the ambient atmosphere using a valve associated with the reservoir.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basic features of the type of cooling system to which the present invention is directed.

Figure 6:
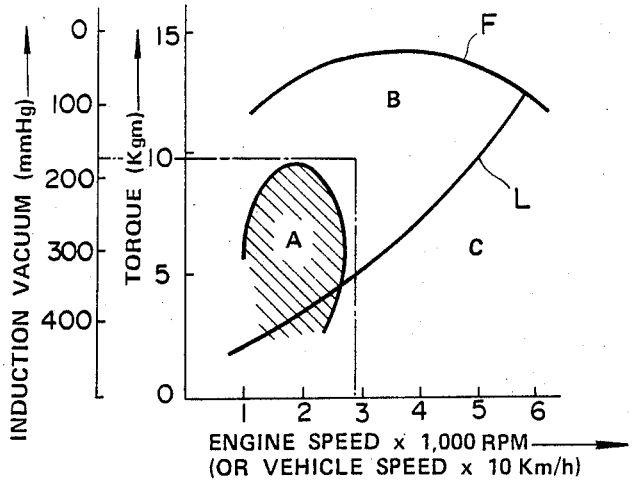
FIG. 6 is a diagram showing in terms of engine load and engine speed the various load zones which are encountered by an automotive internal combustion engine.
Figure 7:
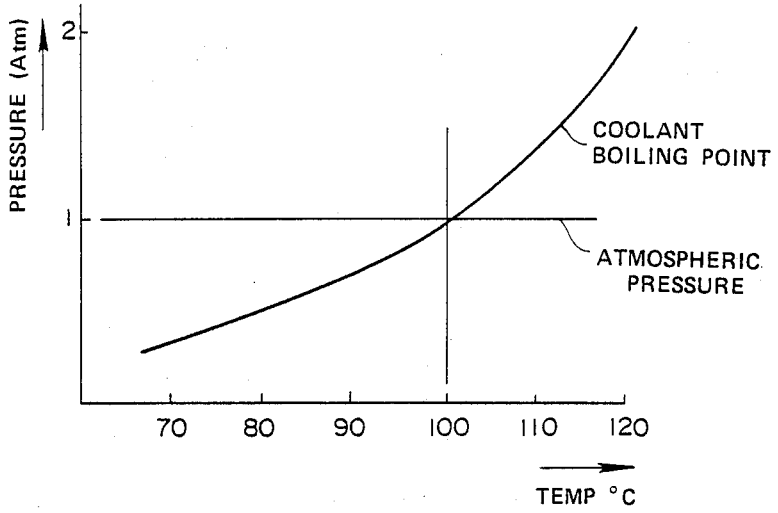
FIG. 7 is a graph showing in terms of pressure and temperature the changes in the coolant boiling point in a closed circuit type evaporative cooling system.

FIG. 6 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones A, B and C denote respectively low load/low engine speed operation such as encountered during what shall be referred to "urban cruising"; low speed high/load engine operation such as hillclimbing, towing etc., and high engine speed operation such as encountered during high speed cruising.

A suitable coolant temperature for zone A is approximately 100°–110° C.; for zone B 80°–90° C. and for zone C 90°–100° C. The high temperature during "urban cruising" promotes improved thermal efficiency. On the other hand, the lower temperatures of zones B and C are such as to improve charging efficiency and ensure that sufficient heat is removed from the engine and associated structure to prevent engine knocking and/or thermal damage.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during "urban cruising" by circulating only a limited amount of cooling air over the radiator, it is possible reduce the rate of condensation therein and cause the pressure within the cooling system to rise above atmospheric and thus induce the situation, wherein the engine coolant boils at temperatures above 100° C. for example at approximately 110° C.

In addition to the control afforded by the air circulation the present invention is arranged to control the pressure prevailing in the system. The combination of the two controls enables the temperature at which the coolant boils to be quickly brought to and held close to that deemed most appropriate for the instant set of operation conditions.

On the other hand, during high speed cruising for example, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 100° C.

In the interest of clarity each of the zones of control be discussed in detail. It should be noted that the figures quoted in this discussion relate to a reciprocating type internal engine having a 1800 cc displacement.

ZONE A

In this zone (low speed/low torque) as the torque requirements are not high, emphasis is placed on good fuel economy. Accordingly, the lower limit of the temperature range of 100° to 110° C. is selected on the basis that, above 100° C. the fuel consumption curves of the engine tend to flatten out and become essentially constant. On the other hand, the upper limit of this range is selected in view of the fact that if the temperature of the coolant rises to above 110° C., as the vehicle is inevitably not moving at any particular speed during this mode of operation there is very little natural air circulation within the engine compartment and the temperature of the engine room tends to become sufficiently high as to have an adverse effect on various temperature sensitive elements such as cog belts of the valve timing gear train, elastomeric fuel hoses and the like. Accordingly, as no particular improvement in fuel consumption characteristics are obtained by controlling the coolant temperatrue to levels in excess of 110° C., the upper limit of zone A is held thereat.

It has been found that the torque generation characteristics tend to drop off slightly with temperatures above 100° C., accordingly, in order to minimize the loss of torque it is deemed advantageous to set the upper torque limit of zone A in the range of 7 to 10 kgm.

The upper engine speed of this zone is determined in view of that fact that above engine speeds of 2400 to 3600 RPM a slight increase in fuel consumption characteristics can be detected. Hence, as it is fuel economy rather than maximum torque production characteristics which are sought in this zone, the boundry between the low and high engine speed ranges is drawn within the just mentioned engine speed range. It will be of course appreciated that as there are a variety of different types of engines on the market—viz., diesel engines (eg. trucks industrial vehicles), high performance engines (eg. sports cars), low stressed engines for economical urban use vehicles, etc., the above mentioned ranges cannot be specified with any particular type in mind but do hold generally true for all types.

ZONE B

In this zone (high torque/low engine speed) torque is of importance. In order to avoid engine knocking, improve engine charging efficiency, reduce residual gas in the engine combustion chambers and maximize torque generation, the temperature range for this zone is selected to span from 80° to 90° C. With this a notable improvement in torque characteristics is possible. Further, by selecting the upper engine speed for this zone to fall in the range of 2,400 to 3600 RPM it is possible to improve torque generation as compared with the case wherein the coolant temperature is held at 100° C., while simultaneously improving the fuel consumption characteristics.

The lower temperature of this zone is selected in view of the fact that if anti-freeze is mixed with the coolant, at a temperature of 80° C. the pressure prevailing in the interior of the cooling system lowers to approximately 630 mmHg. At this pressure the tendancy for atmospheric air to leak in past the gaskets and seals of the engine becomes particularly high. Hence, in order to avoid the need for expensive parts in order to maintain the relatively high negative pressure (viz., prevent crushing of the radiator and interconnecting conduiting) and simultaneously prevent the invasion of air the above mentioned lower limit is selected.

ZONE C

In this zone (high speed) as the respiration characteristics of the engine inherently improve, it is not necessary to maintain the coolant temperature as low as in zone B for this purpose. However, as the amount of heat generated per unit time is higher than during the lower speed modes the coolant tends to boil much more vigorously. As a result an increased amount of liquid coolant tends to bump and froth up out of the coolant jacket and find its way into the radiator.

Until the volume of liquid coolant which enters the radiator reaches approximately 3 liters/min. there is little or no adverse effect on the amount of heat which can released from the radiator. However, in excess of this figure, a marked loss of heat exchange efficiency may be observed. Experiments have shown that by controlling the boiling point of the coolant in the region of 90° C. under high speed cruising the amount of liquid coolant can kept below the critical level and thus the system undergoes no particular adverse loss of heat release characteristics at a time when the maximization of same is vital to prevent engine overheat.

It has been further observed that if the coolant temperature is permitted to rise above 100° C. then the temperature of the engine lubricant tends to rise above 130° C. and undergo unnecessarily rapid degradation. This tendancy is particular notable if the ambient temperature is above 35° C. As will be appreciated if the engine oil begins to degrade under high temperature, heat sensitive bearing metals and the like of the engine also undergo damage.

Hence, from the point of engine protection the coolant is within the range of 90°-100° C. once the engine speed has exceeded the value which divides the high and low engine speed ranges.

Figure 1:
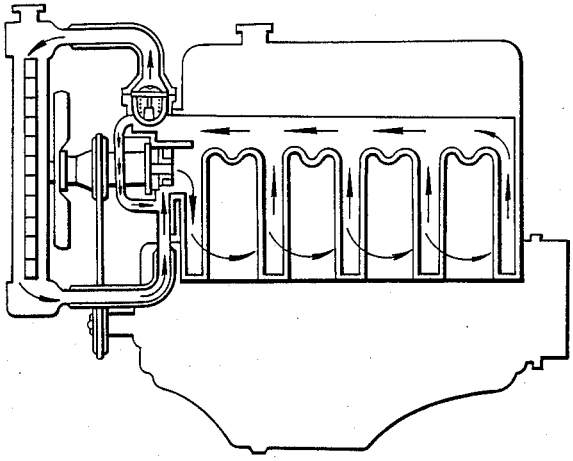
FIG.1 (PRIOR ART)
FIGS. 1 to 5 show the prior art arrangements discussed in the opening paragraphs of the instant disclosure.
Figure 2:
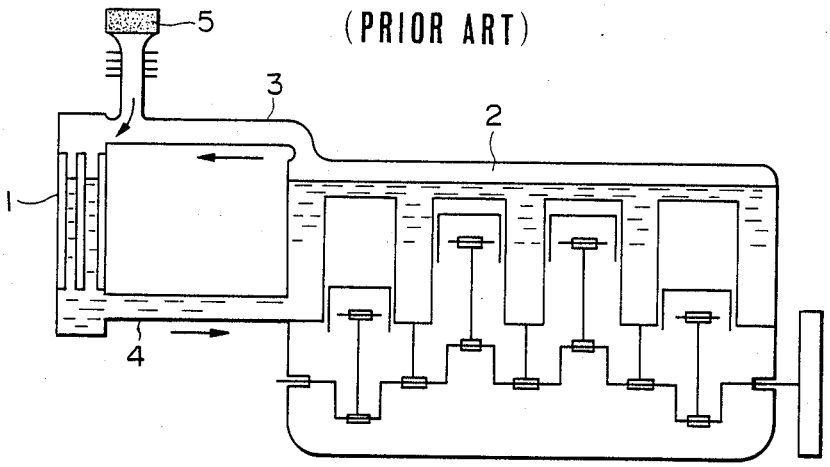
FIG.2 (PRIOR ART)
Figure 3:
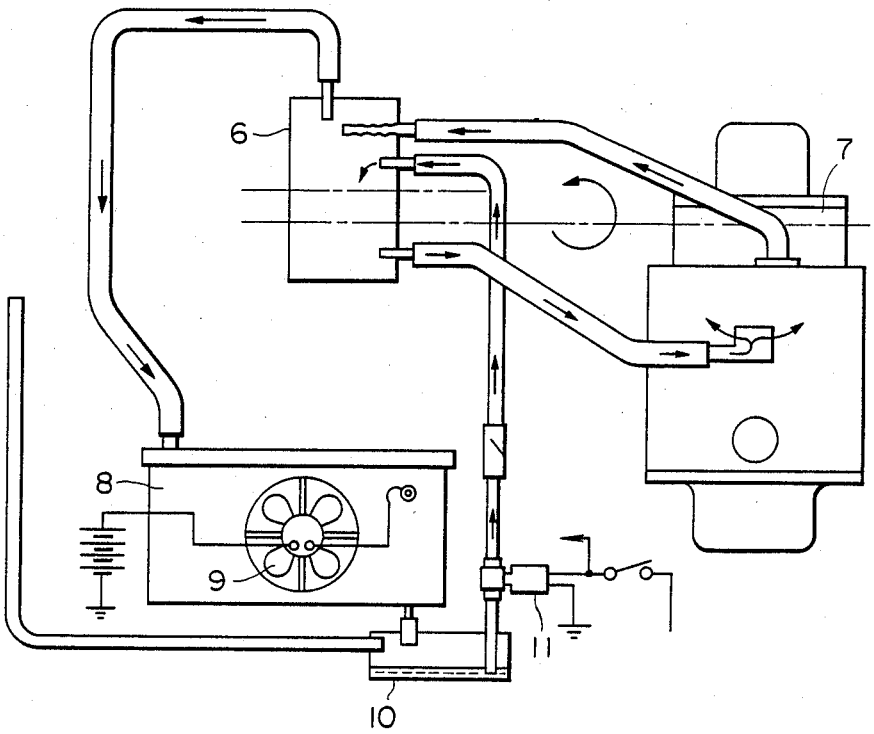
FIG. 3 (PRIOR ART)
Figure 4:
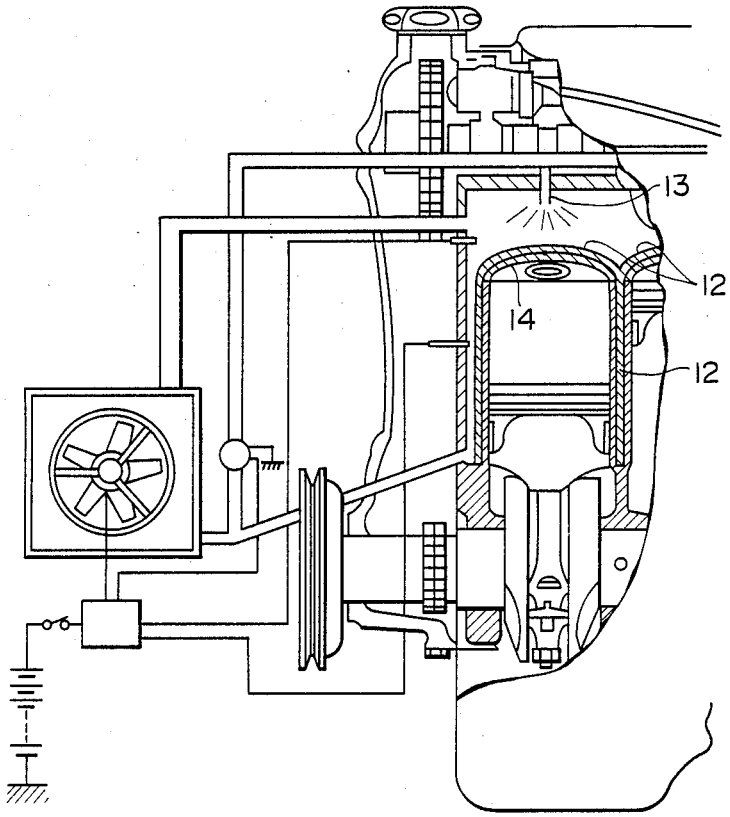
FIG.4 (PRIOR ART)
Figure 5:
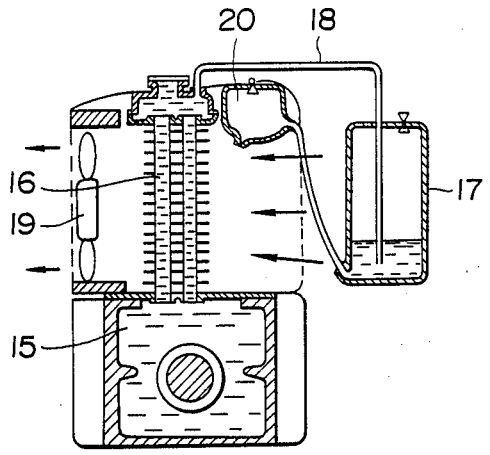
FIG.5 (PRIOR ART)
Figure 9:
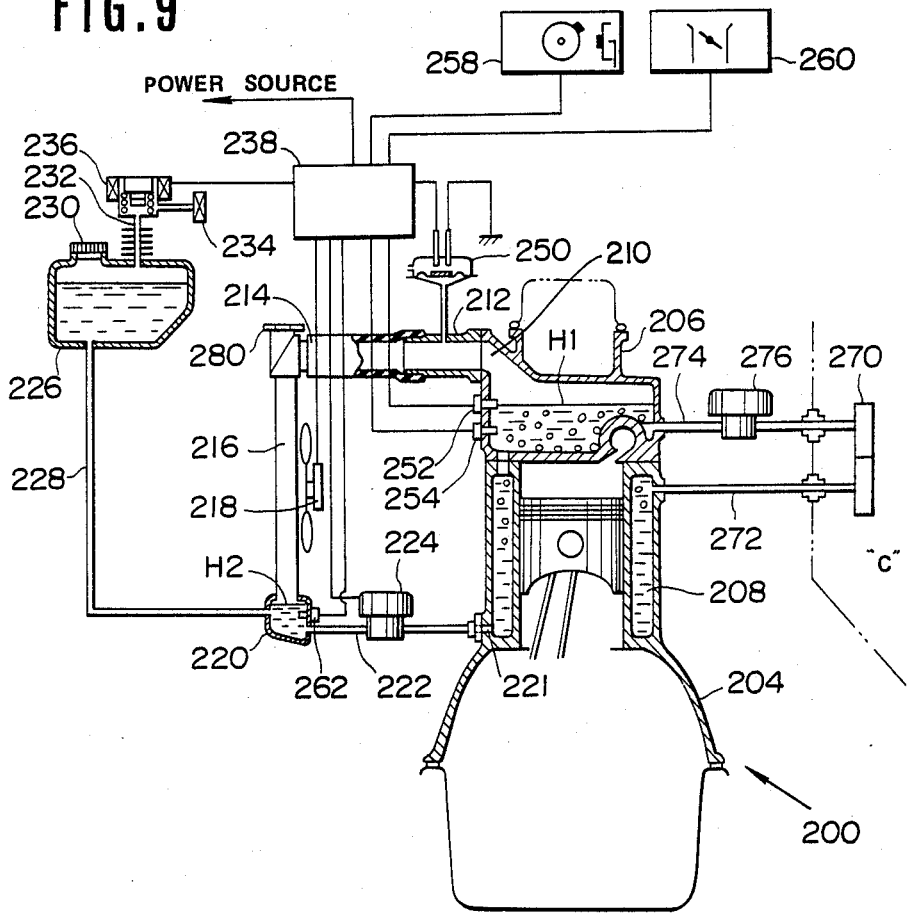
FIG. 9 shows an embodiment of the present invention.

FIG. 9 of the drawings shows an engine system to which a first embodiment of the invention is applied. In this arrangement an internal combustion engine 200 includes a cylinder block 204 on which a cylinder head 206 is detachably secured. The cylinder head and block are formed with suitable cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condensor 216 or radiator as it will be referred to hereinafter. This radiator 216 has a maximum heat exchange capacity which is higher than the maximum heat removal requirement of the engine 200. Located adjacent the radiator 216 is a selectively energizable electrically driven fan 218 which is arranged to induce a cooling draft of air to pass over the heat exchanging surface of the radiator 216 upon being put into operation. This fan is arranged to be energizable at different levels.

A small collection vessel 220 or lower tank as it will be referred to hereinlater, is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit.

A coolant reservoir 226 is arranged to constantly communicate with the lower tank 220 via a supply/discharge conduit 228. The reservoir includes a filler port (no numeral) which is hermetically closed by a cap 230. The interior of the reservoir 226 communicates with the ambient atmosphere via a vent conduit 232. As shown, the vent conduit 232 is provided with a dust filter or the like 234. An electromagnetic valve 236 is disposed in the conduit. In this embodiment this valve is of the normally open type and is arranged to be closed via energization. The section of the vent conduit 232 located between the valve 236 and the reservoir proper is finned to ensure that any coolant vapor that might reach the same while valve is open condenses and is retained in the reservoir 226.

The operation of the valve is controlled by a control circuit 238.

A pressure differential responsive diaphragm operated switch arrangement 250 is arranged to communicate with the vapor manifold. This "pressure sensor" as it will be referred to hereinlater is arranged to switch from one state to another upon the pressure prevailing within the cooling circuit (viz., the coolant jacket 208, vapor manifold 214, vapor conduit 214, radiator 216 and return conduit 222) dropping below atmospheric pressure by a predetermined amount. In this embodiment the pressure sensor 250 is arranged to switch upon the pressure in the cooling circuit falling to a level in the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or "hot spots".

Located below the level sensor 252 so as to be immersed in the liquid coolant is a temperature sensor 254. The output of the level sensor 252 and the temperature sensor 254 are fed to the control circuit 238 or modulator which is suitably connected with a source of EMF (not shown). It will be noted that it is possible to use a pressure sensor in lieu of a temperature sensor. However, pressure sensors tend to be expensive and to be overly responsive to momentary pressure fluctuations which occur in the coolant jacket. By immersing the temperature sensor in the liquid coolant is is possible to obtain a stable and reliable temperature reading.

The control circuit 238 further receives an input from an engine speed sensor 258 such as the engine distributor (or like device) and an input from a load sensing device 260 such as a throttle valve position sensor. It will be noted that as an alternative to throttle position, the output of an air flow meter, an induction vacuum sensor or the pulse width of fuel injection control signal may be used to indicate load. In the case the engine is fuel injected it is also possible to use the frequency of the fuel injection signal as an indication of engine speed as well as using the pulse width to indicate load.

A second level sensor 262 is disposed in the lower tank 220 at a level H2. The purpose for the provision of this sensor will become clear hereinafter when a discussion of the operation of the embodiment is made.

From the view point of safety it is advantageous to arrange level sensors 252 and 262 to assume an ON state when the levels are above H1 and H2, respectively. With this arrangement should either fail a tendency for the system to be overfilled with liquid coolant rather than the reverse is induced by the resulting OFF indication.

Leading from a section of the coolant jacket 208 formed in the cylinder block 204 to a heater core 270 disposed in the passenger compartment of the vehicle (no numeral) in which the engine 200 is mounted, is a heater supply conduit 272. Leading from the heater core 270 to a section of the coolant jacket 208 formed in the cylinder head 206 is a heater return conduit 274. A coolant circulation pump 276 is disposed in this conduit and arranged to induce coolant to flow through the heating circuit (supply conduit 272, core 270 and return conduit 272) when energized. With this arrangement when the heater is in use the coolant which is returned to the coolant jacket enters the same in a zone wherein the most vigorous boiling occurs. As this coolant is relatively cool having released some of its heat to the cabin "C", it tends the quel the violence with which the coolant tends boils and thus under high speed/load conditions wherein a large amount of heat is produced by the engine, limit the amount of liquid coolant which tends to bump and froth its way out of the coolant jacket and find its way into the radiator 216.

OPERATION OVERVIEW

Prior to use the cooling circuit is filled to the brim with coolant (for example water or a mixture of water and antifreeze or the like) via the filling port (no numeral) formed at the top of the radiator 216 and the cap 280 securely set in place to seal the system. A suitable quantity of additional coolant is then introduced into the reservoir 226 via the filler port formed therein a cap 230 hermetically secured in place.

When the engine is started, as the coolant jacket 208 is completely filled with stagnant coolant, the heat produced by the combustion in the combustion chambers cannot be readily released via the radiator 216 to the ambient atmosphere and the coolant rapidly warms and begins to produce coolant vapor.

The vapor pressure which subsequently develops in the coolant jacket displaces the liquid coolant of the cooling circuit (via., the closed loop comprised of the coolant jacket vapor manifold, radiator, lower tank 220 and coolant return conduit 222) out to the reservoir. At this time the electromagnetic valve 236 is left open so that compression of the air contained in the upper section and subsequent resistance to displacement is prevented.

Figure 8:
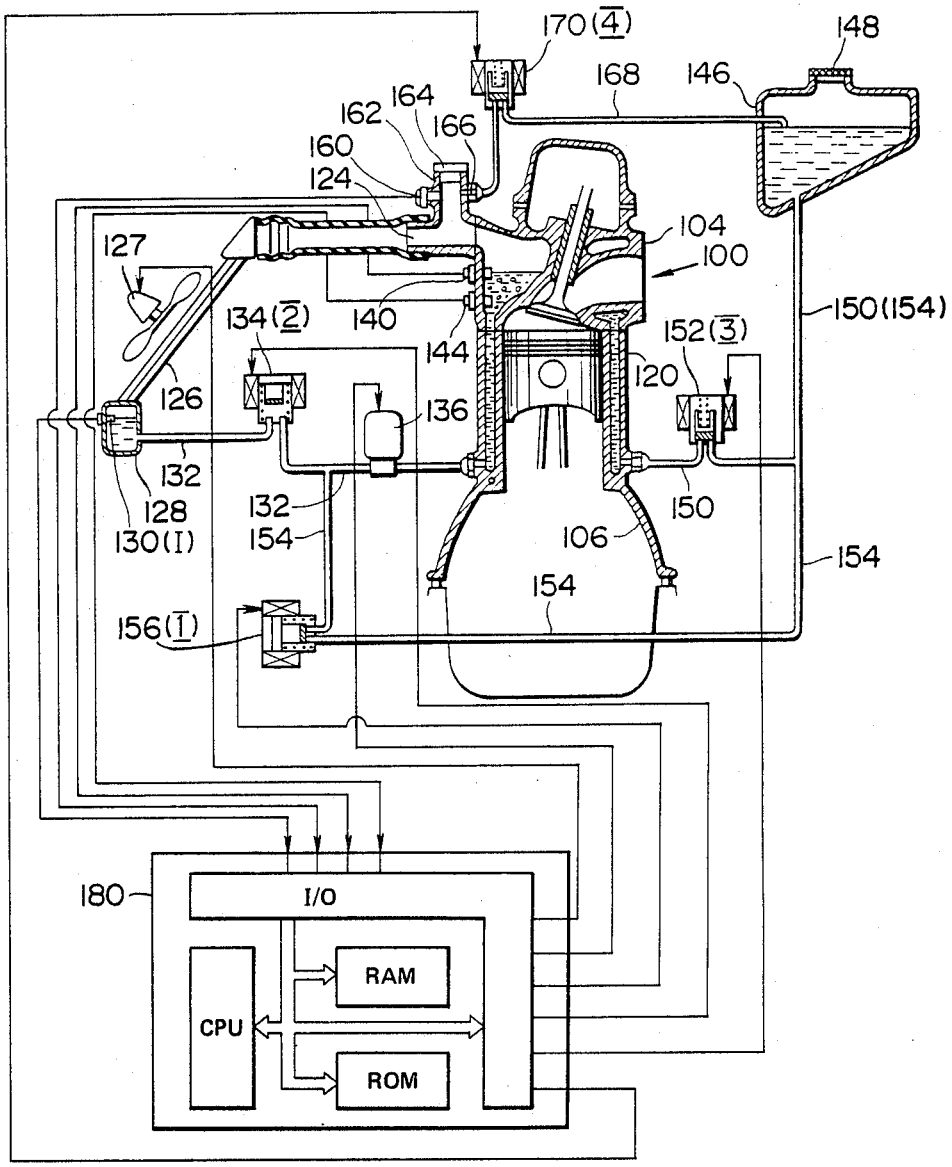
FIG.8 (PRIOR ART)
FIG. 8 shows in schematic elevation the arrangement disclosed in the opening paragraphs of the instant disclosure in conjunction with U.S. Pat. No. 4,549,505.

During this process the outputs of the engine speed sensor 258 and engine load sensor 260 are sampled and the most appropriate temperature for the coolant to be maintained at for the instant set of operating conditions derived. In the instant embodiment the control circuit contains a microprocessor (not shown) similar to that illustrated in FIG. 8. Suitable programs for determining the "target" temperature as it will be referred to, on the basis of the engine speed and load inputs are set in the ROM. As will be appreciated from the previous discussion of FIG. 6 it possible to prepare a table of the nature shown in this figure and perform a table look-up or alternatively derive the appropriate value via the use of an alogrithm. As the various techniques for performing this derivation will be apparent to those skilled in the art of computer programming no further discussion will be made for the sake of brevity.

Following the derivation of the target temperature the output of the temperature sensor 254 is sampled and a comparison made. If the two values are found to be reasonably close then valve 236 can be energized to assume a closed state and thus hermetically seal the system. Following this, temperature control is effected using the fan 218. It will be noted that with the present invention it is possible to sense the level of coolant in the radiator 216 (using level sensor 262) and control the level to which the fan 218 is energized. Viz., if the level of liquid coolant in the coolant jacket 208 is above level H2 the maximum power with which the fan 218 is operated can be reduced, while if the level is below H2 a high level energization is preferable. The reason for this is that while the radiator 216 is partially filled with liquid coolant the amount of coolant vapor which need be condensed is relatively small and even if the maximum fan energization is effected little or no increase in the condensation is achieved. Hence, in order to reduce both power consumption and fan noise, the lower energization level is advantageous.

In the event that the temperature of the coolant drops below that deemed best for the instant set of circumstances, the operation of the fan 218 is stopped. If this fails to remedy the situation and the temperature drops to the point that subatmospheric pressure develops in the coolant jacket 208 to a level at which pressure sensor 250 is triggered, valve 236 is opened. This permits atmospheric pressure to prevail in the upper section of the reservoir 226 and for coolant to be inducted into the cooling circuit via the lower tank 220 due to the less than atmospheric pressure which prevails therein. As the coolant return pump 224 acts as a valve which controls the passage of coolant through the coolant return conduit 222, the freshly introduced coolant raises the level of liquid in the radiator 216 and thus reduces the surface area available for the coolant vapor to release its latent heat of evaporation. The influx of coolant also raises the pressure in the cooling circuit toward atmospheric and thus instantly influences the boiling point of the coolant.

This measure in combination with continued non-operation of the fan quickly brings the boiling point of the coolant to the desired level.

If the temperature of the coolant should rise above the target value in a manner which cannot be brought under control by fan operation alone, it is possible that air or the like has entered the cooling circuit and has collected in the radiator. However, as such material exhibits natural insulating properties, it tends to be cooler than the vapor and thus is pushed toward the bottom of the radiator 216 by the hotter less dense coolant vapor. In the instant embodiment conduit 228 communicates with the lower tank 220 at a level slightly above level H2. Accordingly, upon the non-condensible matter entering the lower tank 220, it tends to escape out to the reservoir 226 before the level sensor 262 indicates that the level of coolant in the radiator has dropped thereto and induce the situation wherein the fan is energized at the "high" level. Viz., high level fan energization tends to lower the pressure prevailing in the radiator and interfere with the purging of the non-condensible matter.

By opening valve 236 in response to the detection of an abnormally high temperature it is possible to facilitate the discharge of the non-condensible matter and simultaneously lower the pressure prevailing in the system as a whole. These measures tend to rapidly bring the overheat problem under control. As the vent conduit 232 is finned even if some coolant vapor manages to reach the upper section of the reservoir 226 it tends to condense in the conduit 232 and precipitate.

When the engine is stopped valve 236 is maintained energized until such time as the pressure sensor 250 senses the presence of a sub-atmospheric pressure in the cooling circuit. During this period it is possible to continue the operation of fan 218 at the "low" level to failiate the removal of the heat which has accumulated in the engine structure per se and which will tend to keep the coolant boiling for a period after the engine is stopped. As will be appreciated, if this measure is not taken sufficient pressure may develop that coolant is displaced out of the cooling circuit with sufficient violence that spillage and permanent loss of coolant via the vent conduit 232 can occur.

Although the arrangement of the above embodiment is such that the level of coolant in the coolant jacket is maintained at level H1 via means which requires the use of level sensor 252 it is within the scope of the present invention to replace the level sensor with an overflow port or ports and an overflow conduit arrangement wherein the overflow port (or ports) are arranged at level H1 and the overflow conduit leads to the lower tank 220 or similar location upstream of the coolant return pump 224.

With this type of arrangement it is preferable to constantly energize pump 224 after the temperature of the coolant exceeds a predetermined level. It is a further requirement that the pump 224 have a capacity which is slightly in excess of the maximum system requirements so that under all modes of operation an excess of liquid coolant is caused to spill over through the overflow ports and hence ensure that the desired level of coolant is maintained in the coolant jacket 208 at all times.

For further details relating to this type of level control arrangement reference may be had to U.S. Pat. No. 4,658,765 issued on Apr. 21, 1987 in the name of Yoshimasa Hayashi and copending U.S. patent application Ser. No, 852,169 filed on Apr. 15, 1986 in the name of Naoki Ogawa, now U.S. Pat. No. 4,662,317, the content of which is hereby incorporated by reference thereto.

What is claimed is:

1. In an internal combustion engine having a structure subject to high heat flux, a cooling system comprising:

a coolant jacket disposed about said structure and into which coolant is introduced in liquid form and discharged in gaseous form;

a radiator in fluid communication with said coolant jacket and in which coolant vapor is condensed to its liquid state;

means for returning the liquid coolant formed in said radiator to said coolant jacket in a manner which maintains the level of liquid coolant in said coolant jacket at a first predetermined level, said first predetermined level being selected to maintain said structure immersed in a predetermined depth of liquid coolant, said coolant jacket, radiator and said liquid coolant returning means defining a cooling circuit;

a reservoir in constant fluid communication with said cooling circuit; and a valve which controls the communication between the interior of said reservoir and the ambient atmosphere, said valve being operable to selectively control the pressure in said reservoir and said cooling circuit.

2. A cooling system as claimed in claim 1, wherein said valve is selectively operable to control the pressure in said reservoir and cooling circuit to superatmospheric and subatmospheric levels.

3. In an internal combustion engine having a structure subject to high heat flux, a cooling system comprising:

a coolant jacket disposed about said structure and into which coolant is introduced in liquid form and discharged in gaseous form;

a radiator in fluid communication with said coolant jacket and in which coolant vapor is condensed to its liquid state;

means for returning the liquid coolant formed in said radiator to said coolant jacket in a manner which maintains the level of liquid coolant in said coolant jacket at a first predetermined level, said first predetermined level being selected to maintain said structure immersed in a predetermined depth of liquid coolant, said coolant jacket, radiator and said liquid coolant returning means defining a cooling circuit;

a reservoir in constant fluid communication with said cooling circuit;

a valve which controls the communication between the interior of said reservoir and the ambient atmosphere, said valve being operable to selectively control the pressure in said reservoir and said cooling circuit;

a temperature sensor disposed in said coolant jacket;

a device associated with said radiator for varying the rate of heat exchange between said radiator and a cooling medium;

means for determining the instant mode of engine operation and for determining a target temperature at which the coolant should be maintained; and means for controlling said valve and said device in a manner which varies the pressure in the cooling circuit and rate of heat exchange between said radiator and the cooling medium in a manner which tends to bring the temperature of the coolant to the target temperature.

4. A cooling system as claimed in claim 3, further comprising a pressure sensor, said pressure sensor being responsive to the pressure differential between the interior of said cooling circuit and the ambient atmosphere.

5. A cooling system as claimed in claim 4, wherein said controlling means is responsive to said pressure sensor.

6. In an internal combustion engine having a structure subject to high heat flux, a cooling system comprising:

a coolant jacket disposed about said structure and into which coolant is introduced in liquid form and discharged in gaseous form;

a radiator in fluid communication with said coolant jacket and in which coolant vapor is condensed to its liquid state;

means for returning the liquid coolant formed in said radiator to said coolant jacket in a manner which maintains the level of liquid coolant in said coolant jacket at a first predetermined level, said first predetermined level being selected to maintain said structure immersed in a predetermined depth of liquid coolant, said coolant jacket, radiator and said liquid coolant returning means defining a cooling circuit;

a reservoir in constant fluid communication with said cooling circuit; and a valve which controls the communication between the interior of said reservoir and the ambient atmosphere, said valve being operable to selectively control the pressure in said reservoir and said cooling circuit;

wherein said valve is disposed in a conduit which leads from said reservoir to the ambient atmosphere, said conduit being finned to condense coolant vapor.

7. A cooling system as claimed in claim 6, wherein said conduit includes an air filter.

8. In an internal combustion engine having a structure subject to high heat flux, a cooling system comprising:

a coolant jacket disposed about said structure and into which coolant is introduced in liquid form and discharged in gaseous form;

a radiator in fluid communication with said coolant jacket and in which coolant vapor is condensed to its liquid state;

means for returning the liquid coolant formed in said radiator said coolant jacket in a manner which maintains the level of liquid coolant in said coolant jacket at a first predetermined level, said first predetermined level being selected to maintain said structure immersed in a predetermined depth of liquid coolant;

said coolant jacket, radiator and liquid coolant return means defining a cooling circuit;

a temperature sensor disposed in said coolant jacket;

means for determining the instant mode of engine operation and for determining a target temperature at which the coolant should be maintained;

a device associated with said radiator for varying the rate of heat exchange between the radiator and a cooling medium surrounding said radiator, a reservoir in constant fluid communication with said cooling circuit;

a valve which controls the fluid communication between the interior of said reservoir and the ambient atmosphere;

control means for operating said valve in a manner which controls the pressure in said reservoir and cooling circuit and for operating said device to vary the rate of heat exchange between said radiator and the cooling medium in a manner which brings the temperature of the coolant in said coolant jacket to the target temperature.

9. A method of cooling an internal combustion engine which has a structure subject to a high heat flux comprising:

introducing liquid coolant into a coolant jacket disposed about said structure;

permitting the liquid coolant to absorb heat and boil;

condensing the coolant vapor produced in said coolant jacket to its liquid form in a radiator;

returning liquid coolant from said radiator to said coolant jacket in a manner which maintains said structure immersed in a predetermined depth of liquid coolant;

storing coolant in a reservoir which constantly communicates with the radiator; and controlling fluid communication between the interior of said reservoir and the ambient atmosphere using a valve associated with said reservoir.

10. A method of cooling an internal combustion engine which has a structure subject to a high heat flux comprising the steps of:

introducing liquid coolant into a coolant jacket disposed about said structure;

permitting the liquid coolant to absorb heat and boil;

condensing the coolant vapor produced in said coolant jacket to its liquid form in a radiator;

returning liquid coolant from said radiator to said coolant jacket in a manner which maintains said structure immersed in a predetermined depth of liquid coolant;

storing coolant in a reservoir which constantly communicates with the radiator;

controlling fluid communication between the interior of said reservoir and the ambient atmosphere using a valve associated with said reservoir;

determining the temperature of the coolant in said coolant jacket;

determining the instant mode of engine operation;

determining on the basis of the instant mode of engine operation a target temperature to which the coolant should be controlled;

controlling the pressure in said coolant jacket and radiator using said valve; and using a device to vary the rate of heat exchange between the radiator and a cooling medium in a manner which tends to bring the temperature of the coolant to said target value.

11. A method as claimed in claim 9, wherein said step of controlling includes selectively inducing super and subatmospheric pressures in said reservoir.

12. In an internal combustion engine having a structure subject to high heat flux:

a cooling system comprising:

a coolant jacket disposed about said structure and into which coolant is introduced in liquid form and discharged in gaseous form;

a radiator in fluid communication with said coolant jacket and in which coolant vapor is condensed to its liquid form;

means for returning the liquid coolant formed in said radiator to said coolant jacket in a manner which maintains the level of liquid coolant in said coolant jacket at a first predetermined level, said first predetermined level being selected to maintain said structure immersed in a predetermined depth of liquid coolant, said coolant jacket, radiator and said liquid coolant returning means defining a cooling circuit;

a reservoir in constant fluid communication with said cooling circuit;

a valve which controls the communication between the interior of said reservoir and the ambient atmosphere; and means responsive to the load on the engine for controlling said valve in a manner wherein a superatmospheric pressure is permitted to develop when the engine is operating under light load conditions.

13. A method of cooling an internal combustion engine which has a structure subject to a high heat flux comprising the steps of:

introducing liquid coolant into a coolant jacket disposed about said structure;

permitting the liquid coolant to absorb heat and boil;

condensing the coolant vapor produced in said coolant jacket to its liquid form in a radiator;

returning liquid coolant from said radiator to said coolant jacket in a manner which maintains said structure immersed in a predetermined depth of liquid coolant;

storing coolant in a reservoir which constantly communicates with said radiator;

controlling the fluid communication between the interior of said reservoir and the ambient atmosphere using a valve associated with said reservoir;

sensing the engine load; and controlling said valve in a manner to permit a superatmospheric pressure to develop in said reservoir when the engine is operating under light load conditions.

* * * * *